US008794624B2

(12) United States Patent
Herrmann

(10) Patent No.: US 8,794,624 B2
(45) Date of Patent: Aug. 5, 2014

(54) METHOD AND APPARATUS FOR A PNEUMATIC BAFFLE TO SELECTIVELY DIRECT A CUT MEDIA IN A MEDIA FEED SYSTEM

(75) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/529,450

(22) Filed: Jun. 21, 2012

(65) Prior Publication Data

US 2013/0341858 A1 Dec. 26, 2013

(51) Int. Cl.
*B65H 5/00* (2006.01)

(52) U.S. Cl.
USPC ..... 271/225

(58) Field of Classification Search
USPC ..... 271/225; 226/7, 97.1–97.4; 242/615.11, 242/615.12; 34/641, 643
See application file for complete search history.

(56) References Cited

U.S. PATENT DOCUMENTS 3,844,189 A * 10/1974 Jardine ..... 271/195
4,252,512 A 2/1981 Kornylak
4,472,888 A 9/1984 Spiller
4,484,500 A 11/1984 Reba et al.
4,494,948 A * 1/1985 Teyssier, Jr. ..... 493/11
4,736,942 A * 4/1988 Wiley ..... 271/284
5,299,364 A 4/1994 Heikkila et al.
5,891,309 A 4/1999 Page et al.
6,241,179 B1 6/2001 Hachiya et al.
6,454,098 B1 9/2002 Dewald et al.
6,558,514 B2 5/2003 Rouhiainen et al.
6,846,151 B2 1/2005 Mayerberg, II et al.
7,140,828 B2 11/2006 Mayerberg, II et al.
7,892,399 B2 2/2011 Graham et al.

* cited by examiner

*Primary Examiner* — Jeremy R Severson

(74) *Attorney, Agent, or Firm* — Ronald E. Prass, Jr.; Prass LLP

(57) ABSTRACT

An approach is provided for directing a cut media in a media feed system. The approach involves causing, at least in part, a media to be fed through an incoming media path. The approach also involves causing, at least in part, air to be supplied through an air input configured to input air along a curved baffle positioned between the incoming media path and at least a first outgoing media path. The approach further involves causing, at least in part, the media to take one of the first outgoing media path and a second outgoing media path based, at least in part, on an interaction between the air supplied through the air input and the curved baffle.

16 Claims, 4 Drawing Sheets

METHOD AND APPARATUS FOR A PNEUMATIC BAFFLE TO SELECTIVELY DIRECT A CUT MEDIA IN A MEDIA FEED SYSTEM

FIELD OF DISCLOSURE

The disclosure relates to an apparatus, method, and computer program useful in printing and/or copying for selectively directing a cut media in a media feed system by way of a pneumatic baffle.

BACKGROUND

Printer and/or copier systems often have duplexing functions and/or inverting functions to enable printing or copying one or more images onto both sides of a two-sided sheeted or cut media. To enable use of both sides, it is often necessary direct cut media into different baffle systems. Media is conventionally directed into a selected baffle system by a mechanical diverter gate. Conventional mechanical diverter gates are actuated and flipped into the an oncoming media's path in an effort to divert a lead edge of the cut media, for example, to the selected baffle system. Conventional duplex printing systems often have two paths, one for returning a media to a duplex or inversion path, and one for outputting the media to another process step or for finishing. Once in the selected baffle system, the sheeted media may be driven through the duplex or inversion path, for example, or output.

Conventional mechanical diverter gates often contact the media to divert the media to a selected baffle system. Additionally, conventional mechanical diverter gates ensure a continuous process path by contacting the media. In conventional diversion systems, any discontinuity in the baffles or drive systems within the printer path leads to pressure on an inked image and causes marking of the image. But, because of this contact, conventional mechanical diverter gates often create pressure points that lead to marking the image, thereby damaging the image because of scraping as the media is fed through the mechanical diverter gate. Further, conventional mechanical diverter gates may also damage the leading edge of the media, or any coating on the media, because of any scraping, or misalignment of the mechanical diverter gate that causes an unexpected lip in the system, for example.

SUMMARY

Therefore, there is a need for an approach for selectively directing a cut media in a media feed system by way of a pneumatic baffle.

According to one embodiment, an apparatus for directing a cut media in a media feed system comprises an incoming media path. The apparatus also comprises a first outgoing media path. The apparatus further comprises a second outgoing media path. The apparatus additionally comprises a curved baffle positioned between the incoming media path and at least the first outgoing media path. The apparatus also comprises an air input configured to input air along the curved baffle. An interaction between air supplied through the air input and the curved baffle causes, at least in part, a media fed through the incoming media path to take one of the first outgoing media path and the second outgoing media path.

According to another embodiment, a method for directing a cut media in a media feed system comprises causing, at least in part, a media to be fed through an incoming media path. The method also comprises causing, at least in part, air to be supplied through an air input configured to input air along a curved baffle positioned between the incoming media path and at least a first outgoing media path. The method further comprises causing, at least in part, the media to take one of the first outgoing media path and a second outgoing media path based, at least in part, on an interaction between the air supplied through the air input and the curved baffle.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments of the invention are illustrated by way of example, and not by way of limitation, in the figures of the accompanying drawings.

DETAILED DESCRIPTION

Examples of a method and apparatus for selectively directing a cut media in a media feed system by way of a pneumatic baffle are disclosed. In the following description, for the purposes of explanation, numerous specific details are set forth in order to provide a thorough understanding of the embodiments of the invention. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

As used herein, the term "media" refers to any two-sided substrate comprising one or more of a paper, polymer, metal, etc. The media may be cut or sheeted into any shape or size.

Figure 1:
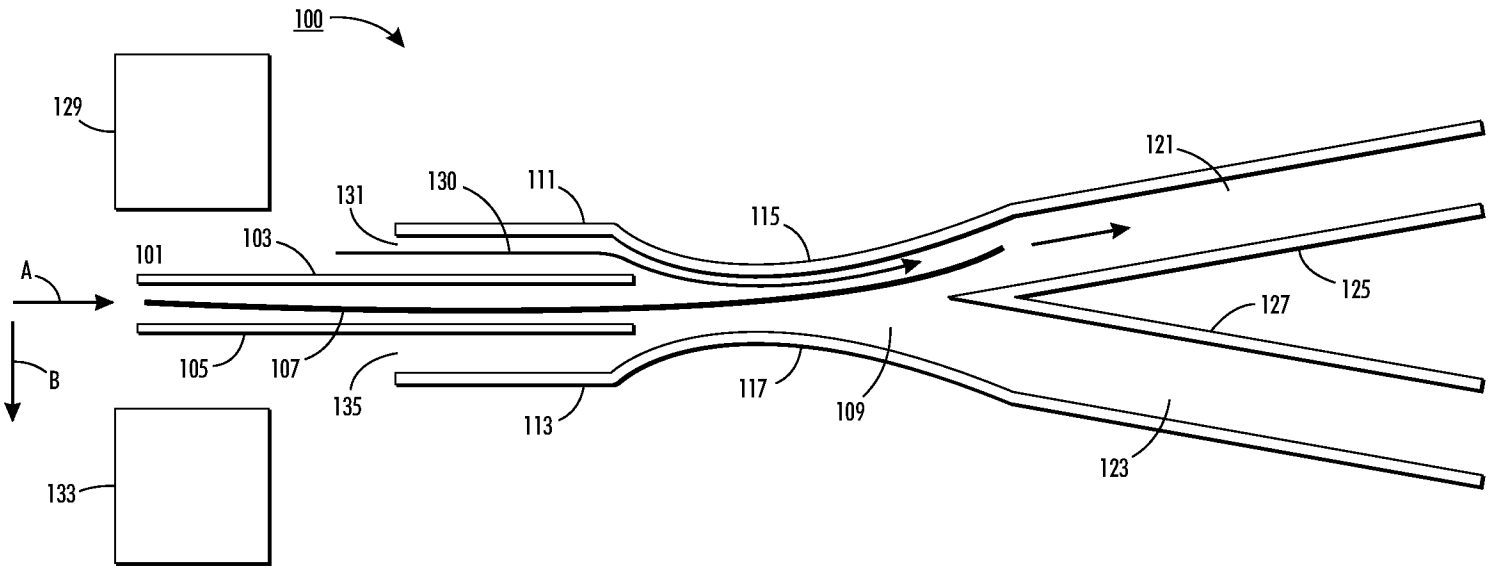
FIG. 1 is a diagram of a system capable of selectively directing a cut media in a media feed system by way of a pneumatic baffle, according to one embodiment.

FIG. 1 is a diagram of a system capable of selectively directing a cut media in a media feed system by way of a pneumatic baffle, according to one embodiment.

Printer and/or copier systems often have duplexing functions and/or inverting functions to enable printing or copying one or more images onto both sides of a two-sided sheeted or cut media. To enable use of both sides, it is often necessary direct cut media into different baffle systems. Media is conventionally directed into a selected baffle system by a mechanical diverter gate. Conventional duplex printing systems often have two paths, one for returned a media to a duplex or inversion path, and one for outputting the printed media. Once in the selected baffle system, the media may be driven through the duplex or inversion path, for example, or output.

Conventional mechanical diverter gates contact the media to divert the media to a selected baffle system. This exposes the printed side of the cut media to marking risk especially in the case of solid ink printing. In solid ink systems, for example, the ink is susceptible to damage whenever it comes into contact with elements of the baffle or drive system. Unfortunately, conventional mechanical diverter gates ensure a continuous process path by contacting the media. For example, conventional mechanical diverter gates are actuated and flipped into the an oncoming media's path in an effort to divert a lead edge of a sheeted media to the selected baffle system.

In conventional diversion systems, any discontinuity in the baffles or drive systems within the printer path leads to pressure on an inked image and causes marking of the image. Accordingly, conventional mechanical diversion gates are usually segmented so that they will be interlaced with an upstream baffle. This creates multiple "fingers" that the lead edge and body of the media encounter during the transition across the diverter gate, for example.

But, because of this contact, conventional mechanical diverter gates often create pressure points that lead to marking the image, thereby damaging the image because of scraping as the media is fed through the mechanical diverter gate. Further, conventional mechanical diverter gates may also damage the leading edge of the media, or any coating on the media, because of any scraping or misalignment of the mechanical diverter gate that causes an unexpected lip in the conventional diversion system.

To address this problem, a system 100 of FIG. 1 introduces the capability to selectively direct a cut media in a media feed system by way of a pneumatic baffle. According to various embodiments, the system 100 forces high velocity air across one or more surfaces of a media to direct the media to a selected downstream baffle and media path. The high velocity air that is forced across the media causes the media to follow a selected path, in some embodiments, because of the Bernoulli effect and the Coanda effect. In other words, by using the pressure differential caused by air moving over the media surface, and using that air's movement around a curved baffle surface, an incoming media can be directed to a selected downstream baffle and outgoing media path from an input baffle without contacting any mechanical gates.

The air flow performs several functions. For example, the high velocity air attracts the media to one side of the system 100 by lowering the pressure on the side of the media that the air is moving across (i.e., the Bernoulli Effect). Additionally, the boundary layer of air created by the moving air reduces any contact risk the media may have with any baffles in the system 100, further reducing marking opportunities caused by contact between the media and the baffles of the system 100. Further, the curved portion of the baffle allows the air and the media to follow the curved baffle surface to the selected baffle and downstream outgoing media path (i.e. the Coanda Effect).

The system 100, therefore, enables a non-contact directional control of various media to direct the media from an input path to a selected exit baffle path for any number of finishing purposes which may include duplex printing, as discussed above. The system 100 eliminates the need for a conventional mechanical diverter gate to direct media to one of two downstream paths. This not only reduces the opportunity for marking an image that is printed on the media, but also simplifies the system 100 by eliminating excess moving parts that could break down, wear down, or add to the cost of a media feeding system by adding various parts to the bill of materials.

According to one example embodiment, as shown in FIG. 1, the system 100 comprises an incoming media path 101 formed between an upper baffle 103 and a lower baffle 105. The incoming media path is configured to feed a media 107 in a process direction A. The media 107 may be any media such as a cut media or sheet that may be a paper product or comprise a polymer or metal, for example. The system 100 further comprises a diversion chamber 109 into which the media 107 is fed. The media diversion chamber comprises an upper chamber wall 111 and a lower chamber wall 113. In this embodiment, the upper chamber wall 111 includes an upper curved baffle 115 and the lower chamber wall 113 includes a lower curved baffle 117. The upper curved baffle 115 and lower curved baffle 117 are convex with respect to an inner portion of the diversion chamber 109, in this example. Alternatively, the upper curved baffle 115 and the lower curved baffle 117 may be concave with respect to the inner portion of the diversion chamber 109.

The system 100 additionally comprises an upper outgoing media path 121 and a lower outgoing media path 123. The upper outgoing media path 121 is formed between the upper chamber wall 111 and an upper exit baffle 125, and the lower outgoing media path 123 is formed between the lower chamber wall 113 and a lower exit baffle 127. In one or more embodiments, the upper exit baffle 125 and lower exit baffle 127 may meet to form a v-shape as illustrated in FIG. 1, but may also be u-shaped, or may be completely separated. As illustrated, the upper curved baffle 115 and the lower curved baffle 117 are positioned between the incoming media path 101 and at least one of the upper outgoing media path 121 and the lower outgoing media path 123.

The system 100 also comprises an upper air input device configured to input air 130 into an upper air input 131 configured to input air along the upper curved baffle 115. The system 100 further includes a lower air input device 133 configured to supply air (illustrated in FIG. 2) into a lower air input 135 configured to input air along the lower curved baffle 117.

In this example, the system 100 is symmetrical. A symmetrical baffle and air system enables the media 107 to be directed to one of the upper outgoing media path 121 or the lower outgoing media path 123 by activating one of the upper air input device 129 or the lower air input device 133. Applying high velocity air to the side of the upper or lower side of the media 107 will draw the media to the selected curved baffle and into the selected upper outgoing media path 121 or lower outgoing media path 123. For example, upper air input device 129 is in an on-state in FIG. 1 to cause the media 107 to be fed into the upper outgoing media path 121.

As discussed above, a boundary layer of air, for example air 130 as illustrated, on one of two sides of the incoming media path 101 directs the media 107 in the direction of the high velocity air 130 that is being input into the upper air input 131 or the lower air input 135 (i.e. the Bernoulli Effect). The direction of diversion of the media from the incoming media path 101 is switchable by turning off an active air input device and activating the other air input device. In this example, upper air input device 129 may be turned off, lower air input device 133 may be turned on to direct the incoming media 107 to the lower outgoing media path 123. Then, lower air input device 133 may be turned off and upper air input device 129 may be turned on, to cause the media 107 to be fed into the upper outgoing media path 121. In other words, the outgoing media path may be selectively controlled on-demand for alternating of downstream processes, for example. Alternatively, the media 107 may be caused to be fed into the upper outgoing media path 121 when the upper air input device 129 is in the on-state, but then the media 107 may be caused to fall into the lower outgoing media path 123 if the upper air input device 129 is in an off-state, and a media thickness, for example, does not prevent the media 107 from falling into the lower outgoing media path 123.

According to various embodiments, the upper and lower air input devices 129 and 133 may be any type of compressor, pump, tube, hose, etc. that is capable or inputting air into the upper and lower air inputs 131 and 135.

Though illustrated as being a symmetrical diversion system, in an alternative embodiment, the system 100 may lack the lower curved baffle 117 and, of the curved baffles discussed, only comprise the upper curved baffle 115 positioned above the incoming media path 101 with respect to a direction of gravity B. Accordingly, the system 100 in this example may only include the upper air input device configured to cause air to flow into the upper air input 131 when in an on-state. In this example, the media 107 is drawn toward the upper curved baffle 115 when the upper air input device is in the on-state to cause the media 107 to be fed from the incoming media path 101 to the upper outgoing media path 121. If the upper air input device is turned off, the media 107 is caused to fall away from the upper curved baffle 115 because of gravity, and the media 107 is fed from the incoming media path 101 to the lower outgoing media path 123.

Alternatively, the system 100 may lack the upper curved baffle 115, and instead only include the lower curved baffle 117 positioned below the incoming media path 101 with respect to the direction of gravity B. In this example, the system 100 may have only the lower air input device 133 of the discussed air input devices configured to cause air to flow into the lower air input 135 when in an on-state. The media 107, in this example, is drawn toward the lower curved baffle 117 when the lower air input device 133 is in the on-state to cause the media 107 to be fed from the incoming media path 101 to the lower outgoing media path 123. But, in this example, the media 107 is caused to be fed from the incoming media path 101 to the upper outgoing media path 121 when the lower air input device 133 is in an off-state. For example, if the media 107 is of a particular weight that causes the media 107 to maintain its direction of movement and not bend because of gravity downward, the media 107 may continue to the upper outgoing media path 121 rather than fall to the lower outgoing media path 123.

If, for example, the system 100 has only one of the upper curved baffle 115 and the lower curved baffle 117, the system 100 may or may not comprise an opposing diversion chamber wall 111 or 113, or an opposite air input 131 or 135, for example, Rather, the system 100 may only have the discussed exit baffles present as necessary to form the outgoing media paths, for example.

Regardless of arrangement, as discussed above, the layer of air supplied through the one or more of the upper air input 131 and the lower air input 135 prevents, or limits, the media 107 from touching the either of the respective curved baffles 115, 117 to prevent or reduce image defects caused by contacting any baffles, chamber walls, or that may be associated with conventional diversion means. In other words, the system 100 uses the thin layer of high velocity air applied between one side of the media and the curved baffle to cause the media to follow the curved baffle (i.e. the Coanda Effect) and "lift" or draw the media 107 (i.e. the Bernoulli Effect) over the curved baffle and into the adjacent exit baffle and outgoing media path.

Figure 2:
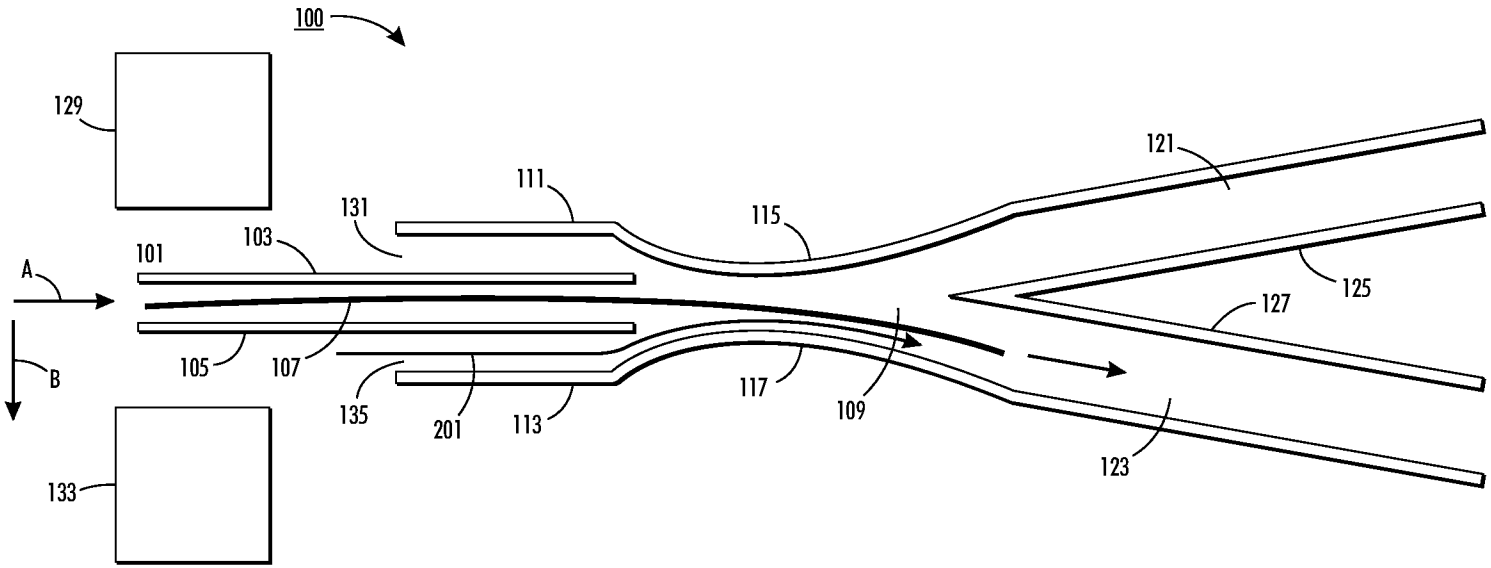
FIG. 2 is a diagram of a system capable of selectively directing a cut media in a media feed system by way of a pneumatic baffle, according to one embodiment.

FIG. 2 is a diagram of the system 100 discussed above in which the media 107 is being diverted into the lower outgoing media path 123. In this example, the upper air input device is in the off-state and the lower air input device 133 is in the on-state. Air 201 is supplied by the lower air input device 133 to the lower air input 135 to input air along the lower curved baffle 117. In other words, the system 100 uses the thin layer of high velocity air applied between one side of the media and the curved baffle to cause the media to follow the curved baffle (i.e. the Coanda Effect) and "lift" or draw the media 107 (i.e. the Bernoulli Effect) over the curved baffle and into the adjacent exit baffle and outgoing media path. As discussed above, a boundary layer of air on the lower side of the incoming media path 101 directs the media 107 in the direction of the high velocity air that is being input into the lower air input 135 (i.e. the Bernoulli Effect).

Figure 3:
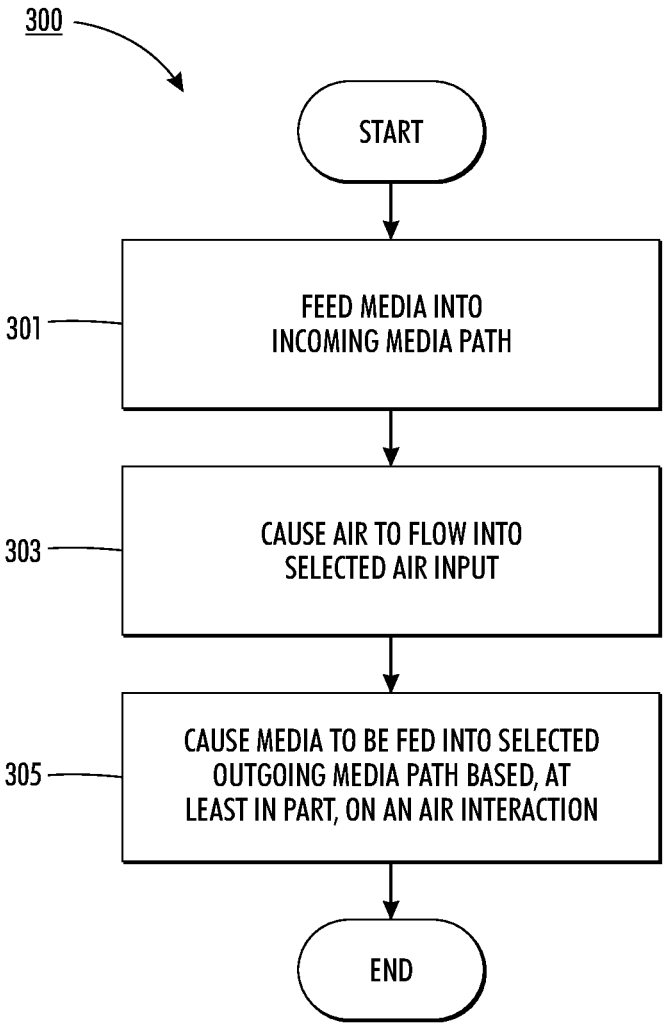
FIG. 3 is a flowchart of a process for selectively directing a cut media in a media feed system by way of a pneumatic baffle, according to one embodiment.
Figure 4:
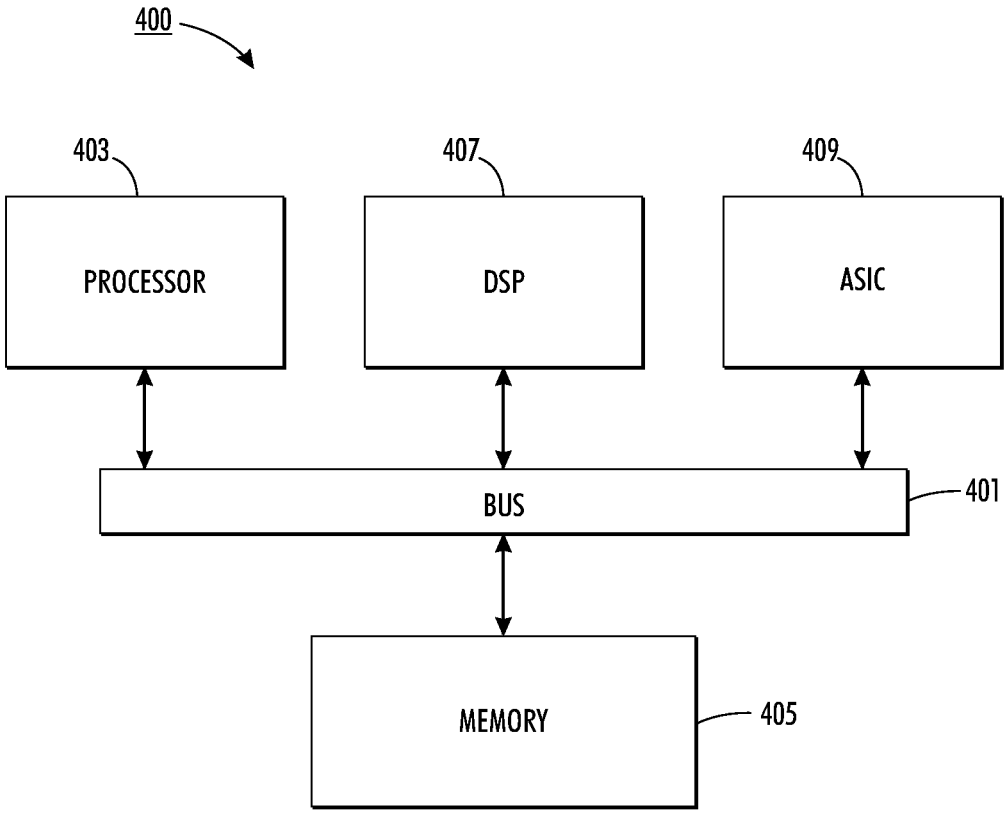
FIG. 4 is a diagram of a chip set that can be used to implement an embodiment.

FIG. 3 is a flowchart of a process for selectively directing a cut media in a media feed system by way of a pneumatic baffle, according to one embodiment. In one embodiment, the system 100 performs the process 300 and may comprise a control module implemented in, for instance, a chip set including a processor and a memory as shown in FIG. 4. In step 301, the system 100 causes, at least in part, the media 107 to be fed through the incoming media path 101. Then, in step 303, the system 100 causes, at least in part, air such as air 130 or air 201, discussed above, to be supplied through an air input such as upper air input 131 or lower air input 133, discussed above, configured to input air along a curved baffle such as upper curved baffle 115 or lower curved baffle 117, discussed above, positioned between the incoming media path 101 and at least a first outgoing media path such as upper outgoing media path 121 or lower outgoing media path 123, discussed above. Then, in step 305, the system 100, causes, at least in part, the media 107 to take one of the upper outgoing media path 121 and the lower outgoing media path 123 based, at least in part, on an interaction between the air supplied through the air input and the curved baffle.

For example, as discussed above, the media 107 is caused, depending on the embodiment, to either be (1) drawn toward one of the upper curved baffle 115 or lower curved baffle 117 by the Bernoulli Effect, to cause the media 107 to be fed into the upper outgoing media path 121 or the lower outgoing media path 123, respectively, by the Coanda Effect, (2) caused to fall away from the upper curved baffle 115 when the air input device is in an off-state to cause the media 107 to be fed into the lower outgoing media path by gravity, or (3) caused to be fed directly from the incoming media path 101 to the upper outgoing media path 121, based on a media stiffness, for example.

The processes described herein for selectively directing a cut media in a media feed system by way of a pneumatic baffle may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

FIG. 4 illustrates a chip set or chip 400 upon which an embodiment may be implemented. Chip set 400 is programmed to selectively direct a cut media in a media feed system by way of a pneumatic baffle as described herein may include, for example, bus 401, processor 403, memory 405, DSP 407 and ASIC 409 components.

The processor 403 and memory 405 may be incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 400 can be implemented in a single chip. It is further contemplated that in certain embodiments the chip set or chip 400 can be implemented as a single "system on a chip." It is further contemplated that in certain embodiments a separate ASIC would not be used, for example, and that all relevant functions as disclosed herein would be performed by a processor or processors. Chip set or chip 400, or a portion thereof, constitutes a means for performing one or more steps of selectively directing a cut media in a media feed system by way of a pneumatic baffle.

In one or more embodiments, the chip set or chip 400 includes a communication mechanism such as bus 401 for passing information among the components of the chip set 400. Processor 403 has connectivity to the bus 401 to execute instructions and process information stored in, for example, a memory 405. The processor 403 may include one or more processing cores with each core configured to perform independently. A multi-core processor enables multiprocessing within a single physical package. Examples of a multi-core processor include two, four, eight, or greater numbers of processing cores. Alternatively or in addition, the processor 403 may include one or more microprocessors configured in tandem via the bus 401 to enable independent execution of instructions, pipelining, and multithreading. The processor 403 may also be accompanied with one or more specialized components to perform certain processing functions and tasks such as one or more digital signal processors (DSP) 407, or one or more application-specific integrated circuits (ASIC) 409. A DSP 407 typically is configured to process real-world signals (e.g., sound) in real time independently of the processor 403. Similarly, an ASIC 409 can be configured to performed specialized functions not easily performed by a more general purpose processor. Other specialized components to aid in performing the inventive functions described herein may include one or more field programmable gate arrays (FPGA), one or more controllers, or one or more other special-purpose computer chips.

In one or more embodiments, the processor (or multiple processors) 403 performs a set of operations on information as specified by computer program code related to selectively directing a cut media in a media feed system by way of a pneumatic baffle. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 401 and placing information on the bus 401. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 403, such as a sequence of operation codes, constitute processor instructions, also called computer system instructions or, simply, computer instructions. Processors may be implemented as mechanical, electrical, magnetic, optical, chemical or quantum components, among others, alone or in combination.

The processor 403 and accompanying components have connectivity to the memory 405 via the bus 401. The memory 405 may include one or more of dynamic memory (e.g., RAM, magnetic disk, writable optical disk, etc.) and static memory (e.g., ROM, CD-ROM, etc.) for storing executable instructions that when executed perform the inventive steps described herein to selectively direct a cut media in a media feed system by way of a pneumatic baffle. The memory 405 also stores the data associated with or generated by the execution of the inventive steps.

In one or more embodiments, the memory 405, such as a random access memory (RAM) or any other dynamic storage device, stores information including processor instructions for selectively directing a cut media in a media feed system by way of a pneumatic baffle. Dynamic memory allows information stored therein to be changed by system 100. RAM allows a unit of information stored at a location called a memory address to be stored and retrieved independently of information at neighboring addresses. The memory 405 is also used by the processor 403 to store temporary values during execution of processor instructions. The memory 405 may also be a read only memory (ROM) or any other static storage device coupled to the bus 401 for storing static information, including instructions, that is not changed by the system 100. Some memory is composed of volatile storage that loses the information stored thereon when power is lost. The memory 405 may also be a non-volatile (persistent) storage device, such as a magnetic disk, optical disk or flash card, for storing information, including instructions, that persists even when the system 100 is turned off or otherwise loses power.

The term "computer-readable medium" as used herein refers to any medium that participates in providing information to processor 403, including instructions for execution. Such a medium may take many forms, including, but not limited to computer-readable storage medium (e.g., non-volatile media, volatile media), and transmission media. Non-volatile media includes, for example, optical or magnetic disks. Volatile media include, for example, dynamic memory. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. An apparatus for directing a cut media in a media feed system comprising:

an incoming media path;

a first outgoing media path;

a second outgoing media path;

a curved baffle positioned between the incoming media path and at least the first outgoing media path;

an air input configured to input air along the curved baffle, wherein an interaction between air supplied through the air input and the curved baffle causes, at least in part, a media fed through the incoming media path to take one of the first outgoing media path and the second outgoing media path;

another curved baffle opposite the curved baffle, the another curved baffle being positioned between the incoming media path and at least the first outgoing media path, another air input configured to input air along the another curved baffle, a first air input device configured to cause air to flow into the air input when in an on-state; and a second air input device configured to cause air to flow into the another air input when in an on-state, wherein the media is drawn toward the curved baffle when the air input device is in the on-state to cause the media to be fed from the incoming media path to the first outgoing media path and the media is drawn toward the another curved baffle when the another air input is in the on-state to cause the media to be fed from the incoming media path to the second outgoing media path;

wherein the curved baffle is positioned above the incoming media path with respect to a direction of gravity, the apparatus further comprising:

an air input device configured to cause air to flow into the air input when in an on-state, wherein the media is drawn toward the curved baffle when the air input device is in the on-state to cause the media to be fed from the incoming media path to the first outgoing media path and the media is caused to fall away from the curved baffle when the air input device is in an off-state to cause the media to be fed from the incoming media path to the second outgoing media path, wherein a controller controls the air input devices to determine the outgoing media path.

2. The apparatus of claim 1, wherein the curved baffle is positioned below the incoming media path with respect to a direction of gravity, the apparatus further comprising:

an air input device configured to cause air to flow into the air input when in an on-state, wherein the media is drawn toward the curved baffle when the air input device is in the on-state to cause the media to be fed from the incoming media path to the second outgoing media path and the media is caused to be fed from the incoming media path to the first outgoing media path when the air input device is in an off-state.

3. The apparatus of claim 1, wherein the curved baffle and the another curved baffle are convex with respect to a space between the curved baffle and the another curved baffle.

4. The apparatus of claim 1, further comprising:

a first incoming media baffle;

a second incoming media baffle positioned to form the incoming media path in a space between the first incoming media baffle and the second incoming media baffle;

a first diversion chamber wall comprising the curved baffle positioned to form the air input between the first incoming media baffle and the first diversion chamber wall.

5. The apparatus of claim 4, further comprising:

a second diversion chamber wall comprising another curved baffle positioned to form another air input between the second incoming media baffle the second diversion chamber wall, wherein the media is drawn toward the curved baffle when air is input through the air input to cause the media to be fed from the incoming media path to the first outgoing media path and the media is drawn toward the another curved baffle when air is input into the another to cause the media to be fed from the incoming media path to the second outgoing media path.

6. The apparatus of claim 1, wherein a layer of air supplied through the air input prevents the media from touching the curved surface.

7. The apparatus of claim 1, further comprising:

at least one exit baffle configured to form at least part of the first outgoing media path and the second outgoing media path.

8. The apparatus of claim 7, wherein the at least one exit baffle is v-shaped.

9. A method for directing a cut media in a media feed system comprising:

causing, at least in part, a media to be fed through an incoming media path;

causing, at least in part, air to be supplied through an air input configured to input air along a curved baffle positioned between the incoming media path and at least a first outgoing media path;

causing, at least in part, the media to take one of the first outgoing media path and a second outgoing media path based, at least in part, on an interaction between the air supplied through the air input and the curved baffle;

causing, at least in part, the media to be drawn toward the curved baffle to cause the media to be fed from the incoming media path to the first outgoing media path when a first air input device configured to cause air to flow into the air input is in an on-state; and causing, at least in part, the media to be drawn toward another curved baffle to cause the media to be fed from the incoming media path to the second outgoing media path when a second air input device configured to cause air to flow into another air input configured to input air along the another curved baffle is in an on-state, wherein the another curved baffle is positioned opposite the curved baffle, and the another curved baffle is positioned between the incoming media path and at least the first outgoing media path;

wherein the curved baffle is positioned above the incoming media path with respect to a direction of gravity, the method further comprising:

causing, at least in part, the media to be drawn toward the curved baffle to cause the media to be fed from the incoming media path to the first outgoing media path when an air input device configured to cause air to flow into the air input is in an on-state, wherein the media is caused to fall away from the curved baffle when the air input device is in an off-state to cause the media to be fed from the incoming media path to the second outgoing media path.

10. The method of claim 9, wherein the curved baffle is positioned below the incoming media path with respect to a direction of gravity, the method further comprising:

causing, at least in part, the media to be drawn toward the curved baffle to cause the media to be fed from the incoming media path to the second outgoing media path when an air input device configured to cause air to flow into the air input is in an on-state, wherein the media is caused to be fed from the incoming media path to the first outgoing media path when the air input device is in an off-state.

11. The method of claim 9, wherein the curved baffle and the another curved baffle are convex with respect to a space between the curved baffle and the another curved baffle.

12. The method of claim 9, wherein a first incoming media baffle and a second incoming media baffle are positioned to form the incoming media path in a space between the first incoming media baffle and the second incoming media baffle, and a first diversion chamber wall comprising the curved baffle is positioned to form the air input between the first incoming media baffle and the first diversion chamber wall.

13. The method of claim 12, further comprising:

causing, at least in part, the media to be drawn toward the curved baffle when air is input through the air input to cause the media to be fed from the incoming media path to the first outgoing media path; and causing, at least in part, the media to be drawn toward the another curved baffle when air is input into the another to cause the media to be fed from the incoming media path to the second outgoing media path, wherein a second diversion chamber wall comprising another curved baffle is positioned to form another air input between the second incoming media baffle the second diversion chamber wall.

14. The method of claim 9, wherein a layer of air supplied through the air input prevents the media from touching the curved surface.

15. The method of claim 9, wherein at least one exit baffle is configured to form at least part of the first outgoing media path and the second outgoing media path.

16. The method of claim 15, wherein the at least one exit baffle is v-shaped.

* * * * *